United States Patent [19]

Arnett, Jr.

[11] Patent Number: 4,557,674

[45] Date of Patent: Dec. 10, 1985

[54] FLOW SENSING SPEED CONTROL FOR PRESSURE FLUID MOTOR

[76] Inventor: Robert D. Arnett, Jr., 4534 College Park, Dallas, Tex. 75229

[21] Appl. No.: 509,419

[22] Filed: Jun. 30, 1983

[51] Int. Cl.[4] ..... F01C 21/12

[52] U.S. Cl. ..... 418/15; 418/40; 91/421

[58] Field of Search ..... 418/40, 15, 270; 91/433, 434, 449, 452, 421, 21; 60/466, 602

[56] References Cited

U.S. PATENT DOCUMENTS

| | | | |
|---|---|---|---|
| 231,871 | 8/1880 | Vanbriggle | 91/421 |
| 2,846,984 | 8/1958 | Zwayer | 418/15 |
| 3,684,411 | 8/1972 | Cameron | 418/15 |
| 3,930,764 | 1/1976 | Curtiss | 418/43 |
| 3,962,872 | 6/1976 | Budzich | 60/466 |
| 4,307,784 | 12/1981 | Smith | 173/12 |
| 4,391,098 | 7/1983 | Kosuge | 60/602 |

FOREIGN PATENT DOCUMENTS

| | | | |
|---|---|---|---|
| 386014 | 5/1922 | Fed. Rep. of Germany | 91/421 |
| 415322 | 6/1924 | Fed. Rep. of Germany | 91/421 |

*Primary Examiner*—William R. Cline
*Assistant Examiner*—John J. McGlew, Jr.
*Attorney, Agent, or Firm*—Glaser, Griggs & Schwartz

[57] ABSTRACT

A rotary vane air or gas motor is provided with a primary exhaust port having an exhaust fluid throttling valve therein for controlling motor speed. The motor includes a secondary exhaust port for discharging exhaust fluid flow from the motor expansible chambers after cutoff of the primary exhaust port. A flow sensing vane member is movably disposed in a flow passage in communication with the secondary exhaust port and is responsive to flow variations to actuate the exhaust fluid throttling valve by connecting linkage. The interconnected exhaust fluid throttling valve and flow sensing vane function as a motor speed limiting governor.

7 Claims, 4 Drawing Figures

FLOW SENSING SPEED CONTROL FOR PRESSURE FLUID MOTOR

BACKGROUND OF THE INVENTION

1. Field of the Invention

The present invention pertains to a pressure fluid motor such as a rotary vane type motor which is provided with a flow sensing speed control device for throttling the flow of pressure fluid in the motive fluid exhaust passage.

2. Background

In the art of pressure fluid motors there are many applications wherein the motor is subject to a sudden reduction in its driven load or the motor may, while being supplied with motive fluid, be decoupled from the load either intentionally or inadvertently. In such instances it is desirable to be able to limit motor speed to prevent damage to the motor and/or the load which would result from an overspeed condition. Several inventions have been developed in the art of air and gas motor governors or speed control mechanisms including, for example, mechanisms which utilize centrifugal flyweights or the so called flyball governor principle. Although these devices are widely used, they are mechanically complicated and expensive and are not easily adapted to some types of fluid motors. Other types of controls for pressure fluid motors are adapted to sense a pressure differential across an orifice or restriction in the fluid flow path. These types of controls are subject to unstable operating characteristics and are susceptible to malfunction due to contaminants in the working fluid.

Certain types of air and gas motors, for example, also are adapted for reversible operation wherein dual motive fluid inlet ports are provided for introducing pressure gas into the working chambers of the motor to selectively vary the direction of rotation of the motor. In reversible rotary vane type fluid motors, in particular, the alternate fluid inlet port can be used as a secondary exhaust port when the motor is being rotated in one direction, and the port function can be reversed to effect reversal in the direction of rotation of the motor. In motors having dual inlet ports wherein one port functions as an auxiliary exhaust port, depending on the direction of rotation, it has been determined that the flow of fluid exiting the motor through the auxiliary exhaust port may be sensed to effect control of motor speed such as by throttling the exhaust fluid flow through the main or primary exhaust port. This method of motor speed control has been discovered to be effective and relatively uncomplicated and does not preclude the use of the motor as a bi-directional or reversible motor.

SUMMARY OF THE INVENTION

The present invention provides an improved speed control and motive fluid flow control mechanism for a pressure fluid operated motor wherein flow of fluid through an exhaust port is sensed to effect operation of motive fluid throttling valve means to limit motor speed to a predetermined maximum.

In accordance with one aspect of the present invention there is provided an overspeed control mechanism for an air or gas motor comprising a throttling valve interposed in the motor primary exhaust fluid passage, which valve is operably connected to a fluid flow sensing device. The flow sensing device is adapted to sense motor exhaust fluid flow to effect progressive closing of the throttling valve to limit fluid flow through the motor, and therefore also limit motor speed. In a preferred embodiment of the invention fluid flowing through a secondary or auxiliary exhaust port is sensed to effect operation of the throttling valve.

In accordance with another aspect of the present invention there is provided a fluid flow sensing throttling control mechanism for throttling the exhaust fluid flow in a reversible type positive displacement air or gas motor to limit motor speed by throttling a major portion of exhaust fluid flow in response to sensing increased flow of exhaust fluid through a secondary fluid exhaust port. The flow sensing mechanism preferably comprises a movable vane member which responds to a force exerted thereon by fluid flowing through the secondary exhaust port to actuate an exhaust flow throttling valve through means interconnecting the vane and the throttling valve. The flow sensing vane is preferably disposed in an exhaust passage in communication with the auxiliary or secondary exhaust port. The connection between the flow sensing vane and the exhaust fluid throttling valve comprises a unique linkage including a resilient biasing member for biasing the throttling valve and flow sensing vane in a predetermined position.

In accordance with still another aspect of the present invention there is provided a speed limiting control for a positive displacement rotary vane type motor wherein an auxiliary or secondary exhaust port is provided with a flow sensing element which is mechanically interconnected with an exhaust fluid flow throttling valve. The flow sensing element is adapted to respond to increased exhaust fluid flow, which is proportional to motor speed, to progressively throttle the primary exhaust fluid flow from the motor expansible chambers. Further in accordance with the present invention a rotary vane type air or gas motor is provided with dual motive fluid inlet ports, one of which is modified to operate as an auxiliary or secondary exhaust port and which is provided with flow sensing means for throttling the flow of motive fluid through the motor to limit motor speed.

Those skilled in the art will recognize the abovedescribed features and advantages of the present invention as well as other superior aspects thereof upon reading the detailed description which follows in conjunction with the drawing.

DESCRIPTION OF THE PREFERRED EMBODIMENT

Figure 1:
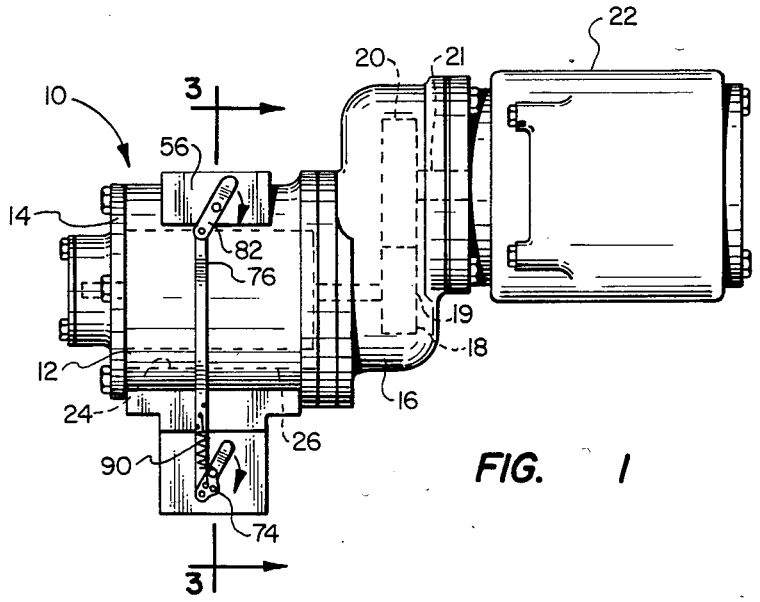
FIG. 1 is a side elevation of a positive displacement pressure fluid motor including the speed limiting control mechanism of the present invention.

Referring to FIG. 1, there is illustrated a positive displacement pressure fluid motor, generally designated by the numeral 10. The motor 10 includes a main housing or cylinder 12 and opposed end covers 14 and 16. The end cover 16 is adapted to enclose and support a reduction gear train comprising gears 18 and 20 for transmitting motor output torque by way of an output shaft 19 to a shaft 21 connected to a driven load comprising, for example, a hydraulic pump 22. Those skilled in the art will appreciate that the present invention may be adapted for use with pressure fluid air or gas motors or motors operating on other working fluids and connected to a variety of driven loads. However, the present invention is also particularly adapted for use in conjunction with a positive displacement rotary vane type motor such as the motor 10.

Figure 2:
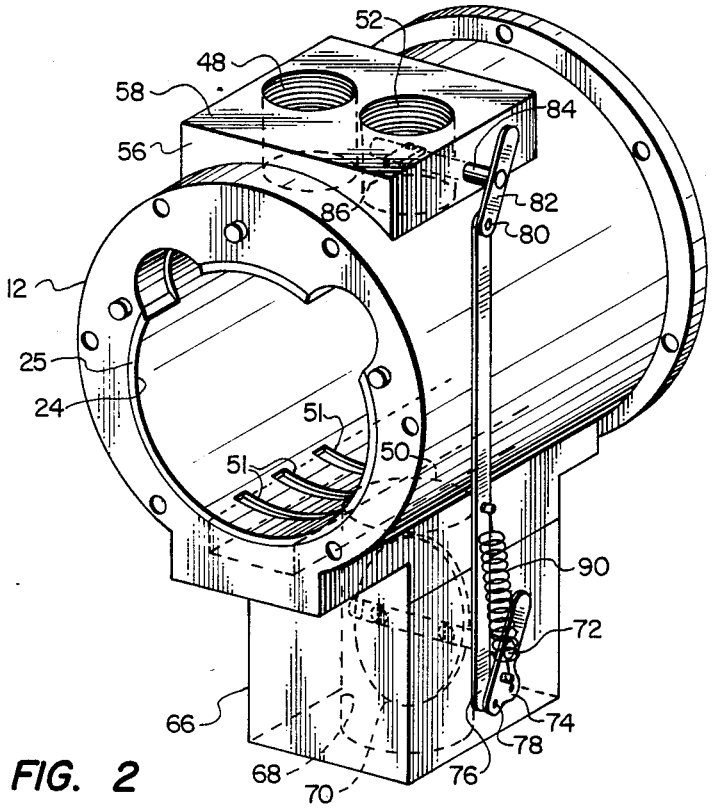
FIG. 2 is a perspective view of the main cylinder housing of the motor illustrated in FIG. 1 showing the speed limiting flow sensing vane, exhaust throttling valve and associated operating linkage.
Figure 3:
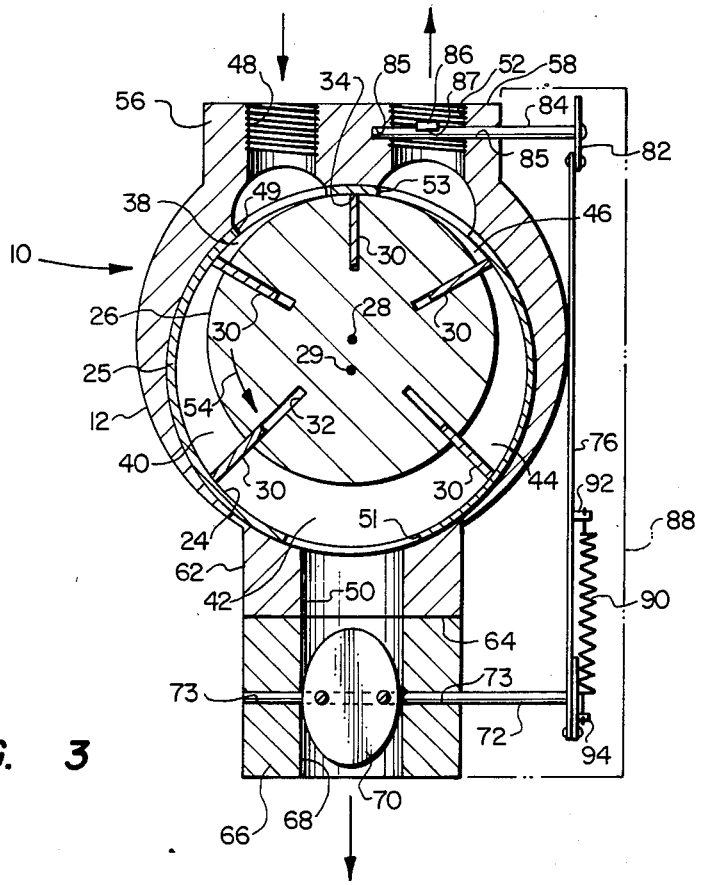
FIG. 3 is a section view taken substantially along the line 3—3 of FIG. 1.

Referring to FIGS. 2 and 3 also, the cylinder housing 12 is provided with an elongated generally cylindrical bore 24, in which is disposed a generally cylindrical rotor 26. The rotor 26 is mounted for rotation in the bore 24 about an axis 28 which is eccentric to the central axis 29 of the bore 24. As indicated in FIGS. 2 and 3, in the specific embodiment of the motor 10 illustrated the housing 12 includes a cylinder insert or liner 25 defining the bore 24 and providing a replaceable wear surface.

Referring particularly to FIG. 3, the rotor 26 is mounted in the housing 12 by suitable bearings, not shown, disposed in the end covers 14 and 16 and the rotor is adapted for rotation about axis 28. The rotor 26 is provided with a plurality of circumferentially spaced apart, radially slidable vanes 30 disposed in respective radially extending slots 32 formed in the rotor. The diameter of the rotor 26 is dimensioned to be such that a very small clearance exists between the periphery of the rotor 26 and the bore 24 as indicated at 34 in FIG. 3 to form a seal point for a series of expansible chambers formed between adjacent ones of the vanes 30, the bore 24 and the periphery of the rotor 26. The expansible chambers are designated by the numerals 38, 40, 42, 44 and 46 for sake of description with regard to FIG. 3. Those skilled in the art will appreciate that the chambers 38, 40, 42, 44, and 46 expand and contract as the rotor 26 rotates in the bore 24 to permit expansion to pressure fluid to drive the rotor and its associated output shaft 19.

The cylinder 12 is provided with a fluid inlet passage 48, a primary exhaust or outlet passage 50 and a secondary exhaust or outlet passage 52 all formed in the housing 12 as shown in FIGS. 2 and 3. The passages 48, 50 and 52 open into the bore 24 at respective ports 49, 51, and 53 formed in the liner 25. The primary exhaust port 51 may comprise a plurality of axially spaced apart slots in the liner 25, as indicated in FIG. 2, and which slots open into an enlarged chamber forming a portion of the passage 50. The ports 49 and 53 are disposed on opposite sides of the seal point 34. The auxiliary or secondary exhaust port 53 may be utilized as a motive fluid inlet port if it is desired to provide for reversible operation of the motor 10. In the configuration of the motor 10 illustrated in the drawing, the direction of the rotation of the rotor 26 is as indicated by the arrow 54 in FIG. 3. The fluid inlet passage 48 and the secondary exhaust passage 52 are formed in a boss 56 forming part of the housing 12 and having a flange or surface 58. Suitable conduits, not shown, may be connected to the boss 56 for conducting pressure fluid to the inlet passage 48 and for conducting secondary exhaust fluid flow from the passage 52 to a suitable discharge point, also not shown.

The housing 12 is also provided with a boss 62 defining the exhaust passage 50 and including a flange or mounting surface 64 for supporting a housing 66 for an extension exhaust passage 68. A butterfly type valve closure member 70 is suitably disposed in the passage 68 for throttling the flow of the major portion of motor exhaust fluid leaving the expansible chambers of the motor 10 by way of the exhaust passage 50. The valve closure member 70 is supported on a rotatable shaft 72 for rotation in the passage 68 to progressively throttle fluid flow through the passage and through the motor 10. The shaft 72 is suitably journalled in bearing means 73 provided in the housing 66.

Figure 4:
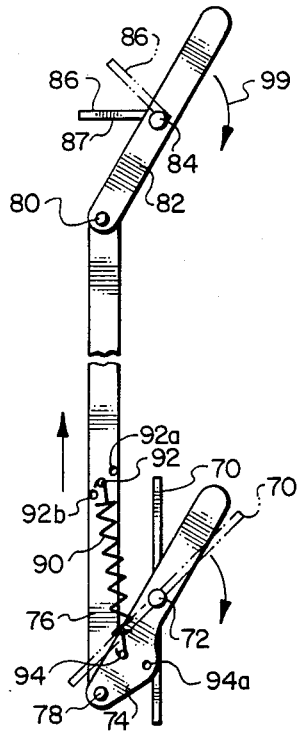
FIG. 4 is a side elevation of the flow sensing and throttling valve mechanism and its associated linkage.

Referring particularly to FIGS. 2 and 4, the shaft 72 is suitably connected to a crank arm 74 for rotation therewith. The crank arm 74 is pivotally connected to a link 76 at pivot means 78. The link 76 is connected at its opposite end by pivot means 80 to a crank arm 82. The crank arm 82 is connected for rotation with a shaft 84 suitably journalled in bearing means 85 in the boss 56, as indicated in FIG. 3. The shaft 84 projects through the auxiliary or secondary exhaust passage 52 and is provided with flow sensing means comprising a vane 86 interposed in the passage 52. The vane 86 is suitably fixed to the shaft 84 for rotation with the shaft. The vane 86 projects substantially perpendicular to the axis of rotation of the shaft 84 across the passage 52 and includes a pressure surface 87 adapted to be impinged by fluid flow through the passage 52. The linkage comprising the shaft 72, crank arm 74, link 76, crank arm 82 and projecting portion of shaft 84 may be disposed in a suitable enclosure, generally designated by the numeral 88, as indicated by the phantom lines in FIG. 3.

Referring particularly to FIG. 4, the crank arm 74, which is pivotable with respect to the link 76, is also interconnected with the link 76 by resilient biasing means comprising a coil spring 90 having opposed end portions connected to respective trunnions 92 and 94 projecting from the link 76 and the crank arm 74, respectively. The coil spring 90 is interconnected between the crank arm 74 and the link 76 in such a way as to create a moment tending to rotate the crank arm 82 so that the vane 86 is positioned substantially normal to the direction of flow of fluid through the exhaust passage 52 and the valve closure member 70 presents minimum resistance to fluid flow in passage 50.

In the position indicated by the solid lines in FIG. 4, the valve closure member 70 is disposed in the open position presenting a minimum resistance to flow of fluid through the primary exhaust fluid flow passage comprising the port 51, passage 50 and the passage 68. However, in response to increased flow of fluid through the auxiliary exhaust port 53 and the passage 52, the vane 86 tends to deflect toward the position indicated by the phantom lines in FIG. 4. Rotation or deflection of vane 86 rotates the crank arm 82 in the direction of the arrow 99 in FIG. 4, which rotation results in movement of the link 76 and the crank arm 74 to rotate the valve closure member 70 to the position indicated by the phantom lines in FIG. 4 to effect throttling of the flow of fluid through the motor 10. As shown in FIG. 4, the coil spring 90 may be connected at one end to the crank arm 74 at an alternate trunnion **94*a* and the opposite end of the coil spring may be connected to alternate trunnions 92*a* or 92*b* on the link 76. This alternate selection of connection points for the coil spring 90 will permit increasing or decreasing the initial tension in the spring whereby the fluid flow through the auxiliary exhaust passage 52** required to rotate the valve closure member toward a closed position may be selectively varied.

In the operation of the motor 10, pressure fluid such as compressed air or gas is admitted to the interior working chambers of the motor through the inlet passage 48 and port 49 to expand and act against the vanes 30 in a known manner to rotate the rotor 26 in the direction of the arrow 54 in FIG. 3. As the chambers 38 and 40, for example, progressively increase in volume, upon rotation of the rotor 26, the trapped gas in each chamber expands to transfer energy to driving the rotor and its driven load. As the leading vane 30 defining one of the expansible chambers, such as chamber 42, moves across the ports 51 the motive air or gas is exhausted from the respective expansible chamber and flows through the exhaust passages 50 and 68. When the valve closure member 70 is in the open position, indicated by the solid lines in FIG. 4, the exhaust fluid flow is substantially unrestricted. As the trailing vane 30 of a particular expansible chamber passes a control edge of the ports 51 in the direction of rotation of the rotor 26 a certain amount of exhaust fluid is trapped in the respective expansible chamber until the chamber moves into a position to open to the exhaust port 53. Accordingly, fluid which is not exhausted through the primary exhaust ports 51 is exhausted through the secondary port 53 prior to reduction of the expansible chambers to essentially zero as the seal point 34 is passed.

The quantity of exhaust fluid is, of course, proportional to the speed of the rotor 26 and, accordingly, the flow of residual exhaust fluid through the auxiliary or secondary exhaust port 53, is also proportional to the speed of the rotor. With increasing flow through the passage 52 the vane 86 tends to be deflected upward to the position shown by the phantom lines in FIG. 4. As previously described, rotation of the vane 86 toward the alternate position indicated in FIG. 4 will effect rotation of the shaft 72 and the valve closure member 70 to progressively throttle the flow of fluid through the exhaust port 50 thereby limiting the speed of the rotor 26. The biasing spring 90 will oppose rotation of the vane 86 in the direction of arrow 99. Depending on the force-deflection characteristic of the spring 90 the force exerted on the vane 86 which is necessary to substantially close valve 70 can be selectively controlled. The spring 90 will, in effect, allow the valve 70 to close until a balanced force condition exists corresponding to a selected maximum fluid flow rate through the motor 10. Accordingly, depending on the size of the vane 86, the tension in the spring 90, and the configuration of the valve closure member 70, the flow sensing vane 86 together with the associated linkage and the closure member 70 serves as a governor or a speed limiting device to prevent damaging overspeeding of the motor 10 and its driven load. The flow sensing vane 86 and the associated mechanism interconnecting the vane with valve closure member 70 comprises a relatively uncomplicated but effective speed limiting device or governor for limiting the motive fluid flow and the rotor speed of the fluid driven motor 10.

The flow sensing vane 86 and the associated mechanism including the valve closure member 70, shaft 72, arm 74, link 76, arm 82 and shaft 84 are also particularly adapted for conversion of a reversible type rotary vane air or gas motor to a motor having a speed limiting governor mechanism. The motor 10, for example, may be utilized as a reversible type motor by connecting either the passage 48 or the passage 52 to a source of pressure air or gas while the other of these passages is utilized as a secondary or auxiliary exhaust passage. The provision of one or the other of ports 49 or 53 as a secondary exhaust port is advantageous due to the configuration of the primary exhaust port 51 which is limited in size and thereby would cause some recompression of fluid, such as the fluid trapped in chambers 44 and 46, without the provision of the secondary exhaust port.

Moreover, if desired, a flow sensing vane arrangement could be provided in the passage 48 with associated linkage similar to that described herein connected to the opposite end of an extended version of the shaft 72 for operation of the vane 70 to throttle exhaust fluid flow. The flow sensing vanes associated with each of the passages 48 and 52 could be provided with lost motion couplings between the vanes and their respective pivot shafts so that only flow of fluid out through the respective passages 48 and 52, when operating as secondary exhaust passages, would be effective to rotate the vanes and their respective pivot shafts together.

The provision of a speed limiting device which functions to control fluid flow through the motor 10 by throttling exhaust fluid flow is also advantageous with respect to its ability to progressively control speed in a more positive and precise manner than may be effected by throttling the flow of high pressure motive inlet fluid at or upstream of the inlet ports. Speed control of positive displacement rotary type motors such as rotary vane, intermeshing gear and lobe type and helical screw type motors in particular is more precise with exhaust fluid flow throttling as compared with throttling high pressure fluid upstream of the motor inlet port. The throttling of exhaust fluid flow also does not cause expansion of fluid within the motor itself and the problems associated therewith including freezing of water vapor resulting from over expansion of a working fluid such as compressed air.

Although a preferred embodiment of the present invention has been described in detail herein those skilled in the art will recognize that various modifications and substitutions may be made to the specific structure disclosed without departing from the scope and spirit of the invention as recited in the appended claims.

What I claim is:

1. A pressure fluid operated motor including:

a housing defining fluid chamber means, rotor means rotatably disposed in said fluid chamber means, shaft means adapted to connect said rotor means to a driven load, a fluid inlet port for conducting pressure fluid at inlet pressure to said fluid chamber means, primary exhaust port means including primary exhaust fluid passage means for conducting exhaust fluid from said fluid chamber means, secondary exhaust port means including secondary exhaust fluid passage means for conducting exhaust fluid from said motor, fluid throttling means operable to throttle the flow of fluid through said motor to limit the speed of said rotor means, and flow sensing means associated with said secondary exhaust fluid passage means and operable to cause said throttling means to limit the flow of fluid through said motor in response to sensing an increasing flow of fluid through said secondary exhaust fluid passage means, said flow sensing means including vane means interposed in said secondary exhaust fluid passage means and operable to be moved by fluid flow through said secondary exhaust fluid passage means to effect operation of said throttling means to throttle fluid flow through said primary exhaust fluid passage means.

2. The motor set forth in claim 1 wherein:

said throtting means comprises a valve closure member interposed in said primary exhaust fluid passage means and movable toward a closed position to throttle the flow of fluid through said motor in response to movement of said vane means.

3. The motor set forth in claim 2 wherein:

said vane means and said valve closure member are mechanically interconnected by a linkage for movement of said valve closure member in response to a force exerted on said vane means by fluid flow through said secondary exhaust fluid passage means.

4. The motor set forth in claim 3 wherein:

said linkage includes a first pivot shaft connected to said valve closure member, a second pivot shaft connected to said vane means, respective crank arms connected to each of said pivot shafts, respectively, and a link interconnecting said crank arms at respective pivot points spaced from said pivot shafts, respectively.

5. The motor set forth in claim 4 including:

means for biasing said valve closure member in an open position to minimize the throttling of fluid flow through said primary exhaust fluid passage means.

6. The motor set forth in claim 5 wherein:

said means for biasing said valve closure member includes spring means interconnecting said link and one of said crank arms.

7. The motor set forth in claim 6 including:

means for adjusting the biasing force of said spring means acting on said link and said one crank arm.

* * * * *